US007576960B2

(12) United States Patent
Gao et al.

(10) Patent No.: US 7,576,960 B2
(45) Date of Patent: Aug. 18, 2009

(54) CIRCUIT PROTECTION DEVICE WITH AUTOMATIC MONITORING OF OPERATION FAULT

(76) Inventors: Shaohua Gao, Zhiguang Industrial Park Liushi Zhen, Yueqing, Zhejiang Province (CN) 325604; Feng Zhao, Zhiguang Industrial Park Liushi Zhen, Yueqing, Zhejiang Province (CN) 325604

( * ) Notice: Subject to any disclaimer, the term of this patent is extended or adjusted under 35 U.S.C. 154(b) by 0 days.

(21) Appl. No.: 11/836,083

(22) Filed: Aug. 8, 2007

(65) Prior Publication Data

US 2008/0024945 A1 Jan. 31, 2008

Related U.S. Application Data

(63) Continuation-in-part of application No. PCT/CN2007/001088, filed on Apr. 3, 2007.

(30) Foreign Application Priority Data

Apr. 3, 2006 (CN) ..... 2006 1 0025417

(51) Int. Cl.

| | |
|---|---|
| ***H02H 3/00*** | (2006.01) |
| ***H02H 9/08*** | (2006.01) |
| *H02H 1/00* | (2006.01) |
| *H02H 73/00* | (2006.01) |

(52) U.S. Cl. ..... 361/42; 361/44; 361/45; 361/114; 361/115

(58) Field of Classification Search ..... None
See application file for complete search history.

(56) References Cited

U.S. PATENT DOCUMENTS

| | | | | |
|---|---|---|---|---|
| 5,459,630 | A | 10/1995 | MacKenzie et al. | |
| 6,052,266 | A * | 4/2000 | Aromin | 361/49 |
| 6,674,289 | B2 | 1/2004 | Macbeth | |
| 6,850,394 | B2 * | 2/2005 | Kim | 361/42 |
| 6,952,150 | B2 * | 10/2005 | Radosavljevic et al. | 335/18 |
| 7,164,564 | B1 | 1/2007 | Finlay et al. | |
| 7,177,129 | B2 * | 2/2007 | Arenz et al. | 361/93.1 |
| 7,212,386 | B1 * | 5/2007 | Finlay et al. | 361/42 |
| 2005/0212522 | A1 | 9/2005 | Finlay, Sr. et al. | |
| 2005/0243484 | A1 | 11/2005 | Kim | |
| 2006/0018059 | A1 | 1/2006 | Elms et al. | |
| 2006/0125622 | A1 * | 6/2006 | Baldwin et al. | 340/514 |

FOREIGN PATENT DOCUMENTS

| | | |
|---|---|---|
| CN | 1106957 A | 8/1995 |
| CN | 1819097 A | 8/2006 |

* cited by examiner

*Primary Examiner*—Albert W Paladini
*Assistant Examiner*—Dharti Patel
(74) *Attorney, Agent, or Firm*—Perkins Coie LLP; Manni Li

(57) ABSTRACT

A circuit interrupter device having a circuit module that automatically monitor the operation of the device and contains a master control system that periodically sends out an impulse that simulates an electric shock signal, a monitoring system that has an interlocking magnifier and comparator, and a signaling system to indicate the normal or faulty operation of the device.

20 Claims, 8 Drawing Sheets

CIRCUIT PROTECTION DEVICE WITH AUTOMATIC MONITORING OF OPERATION FAULT

RELATED APPLICATIONS

The subject application is a continuation-in-part of PCT/CN2007/001088 filed on Apr. 3, 2007, which claims priority from Chinese Patent Application No. 200610025417.9 filed on Apr. 3, 2006 in China. The contents of both parent applications are incorporated herein by reference.

TECHNICAL FIELD

The present invention relates to circuit interrupters, particularly, ground fault circuit interrupters (GFCIs) that automatically monitor the operation of the device and send out alarm signals when operation faults occur.

BACKGROUND OF THE INVENTION

GFCIs detect ground faults, i.e., electric leakage, and automatically trip so that the line contact disconnects from the output contact to avoid an electric shock.

GFCIs may have operational faults caused by various reasons. When the operational faults occur, the electrical and mechanical parts of the device fail to disconnect. The operation faults may be caused by wear and tear of the mechanical parts, erosion, overload caused by improper assembly, mechanical misuse, or electric surge such as a lightning strike. Malfunction of the sensor, detector, switch, trip mechanism, and unstable power supply will all cause operation faults. Short circuit and open circuit resulted from the normal wear and tear or the end of life of the electrical parts cause operation faults as well. When GFCIs have operation faults, they fail to trip and cut off the power. As a result the user may still suffer injury from electric shock.

U.S. Patent Application Publication 2006/0018059 A1 discloses a circuit breaker having a test circuit with one or two indicators, an arc fault signal generator, and first and second test switches.

This type of conventional circuit breaker has disadvantages. First, the interrupter must be triggered manually and periodically, which adds work intensity. Especially when one needs to work with a large number of interrupters, it requires huge work load. Second, if the interrupter fails between the two tests, electric hazard may still occur. Third, if the interrupter fails, it does not provide any alarm signal before the simulated test. Fourth, simulated test requires cutoff of the power supply, which may be inconvenient for the user.

Several U.S. patent application publications disclose circuit protection devices that have self-testing function. However, these devices use high cost parts and have low stability because of the design. Additionally, these devices may not trip and disconnect from the electric power when operation faults occur or the warning signals are given.

U.S. Patent Application Publication 2005/0212522 A1 discloses a circuit protection device which performs self-testing every half-cycle via a test circuit. The circuit protection device does not indicate when the device operates normally.

U.S. Patent Application Publication 2005/0243484 A1 discloses an electric leak breaker having a self-test unit for periodically testing whether the leakage detecting unit or the driving unit is normally operating. The circuit protection device detects malfunction of certain electric units with no indications of the operation status of the other parts or the self-test unit.

U.S. Patent Application Publication 2006/0126522 A1 discloses a self testing fault detector having a controller adapted to perform periodic status tests on a protection circuit without interrupting power to the load. The fault detector performs self test on the fault detection and circuit tripping portions of the device through a two-stage test. The fault detector may fail to signal or trip when the operation fault has occurred.

SUMMARY OF THE INVENTION

The present invention provides a circuit protection device which automatically detects operation faults without manual trigger for the test.

The present invention also provides a circuit protection device which sends out alarm signals for exchange or repair and to avoid electric shock when operation faults occur. At the same time, the circuit protection device trips to avoid electric shock and injury.

The present invention further provides a circuit protection device which does not require cutoff of the power supply to detect the fault and avoids any inconvenience for the user.

The circuit protection device of the present invention comprises a ground fault circuit interrupter protection device (1), a circuit module (2) for auto-monitoring operation faults of the device, a ground fault test circuit (3), and a drive module (4).

The circuit module (2) has a master control system (2-1), a monitoring system (2-2), and a signaling system (2-3). The master control system (2-1) is connected to the power ground line N; the monitoring system (2-2) is connected to the anode of an SCR Q1 and the base of the triode Q3 of the drive module (4); the signaling system (2-3) is connected to the two line pins of the solenoid K1B of the drive module (4).

The output of the ground fault circuit interrupter protection device (1) is connected to the input of the ground fault test circuit (3); the input of the ground fault circuit interrupter protection device (1) is connected to the output of the ground fault test circuit (3); the input of the auto-monitoring circuit module (2) is connected to the output of the ground fault circuit interrupter protection device (1); the output of the auto-monitoring circuit module (2) is connected to the input of the ground fault circuit interrupter protection device (1); the input of the auto-monitoring circuit module (2) is connected to the output of the drive module (4); the output of the ground fault circuit interrupter protection device (1) is connected to the input of the drive module (4).

In the circuit module (2) of the device of the present invention, the master control system (2-1) periodically sends out shock impulses that simulates an electric shock signal; the monitoring system (2-2) has an interlocking amplifier and comparator; the signaling system (2-3) indicates the normal or faulty operation of the device.

In the monitoring system (2-2), a capacitor C10 couples a signal from the SCR Q1 to pin 9 of an integrated block U2C. After a periodic simulated signal is sent out by the master control system (2-1), it is amplified by the U2C and compared by another integrated block U2D, which controls the alarming status of the signaling system (2-3) and prevents mistrip through on or off of the triode Q3. The master control system (2-1) triggers the signaling system (2-3) through a resistor R5 to turn on a light-emitting diode D3-1, and turns on or off the light-emitting diode D3-1 through controlling the monitoring system (2-2) via a diode D10.

The signaling system (2-3) may have a visual alarm, au audible alarm, an alarm through a RF wireless transmission, or an alarm through a wave carrier transmission, or a combination thereof. The visual alarm may contain a dual-color light-emitting diode which emits one color for indicating tripping and at least one color for indicating operation fault. The dual-color light-emitting diode may emit green light to indicate normal operation of the device. The visual alarm may indicate an end-of-life of the device via periodical glitter. Preferably, the visual alarm emits red for indicating the end-of-life of the device. The dual-color light-emitting diode may emit green light to indicate normal operation.

Furthermore, the circuit protection device may comprise an end-of-life system which respectively connect to a positive pin of the SCR Q1 and the base of the triode Q3. The system may activate an end-of-life alarm when it detects a failure to response to a simulated fault signal in the circuit module (2) or the circuit interrupter protective device (1).

The circuit protection device may be used as a GFCI receptacle, a GFCI plug, a GFCI breaker, or a GFCI switch.

Therefore, the device of the present invention detects operation faults without manual and periodic triggers. The device of the present invention sends out alarm signals when operation faults occur to remind the user to replace or fix the device and to avoid the hidden danger of an electric shock from a malfunctioned device. The device of the present invention does not require cutoff of power supply to perform and avoids inconvenience for the user.

DETAILED DESCRIPTION OF THE INVENTION AND EMBODIMENTS

Figure 1:
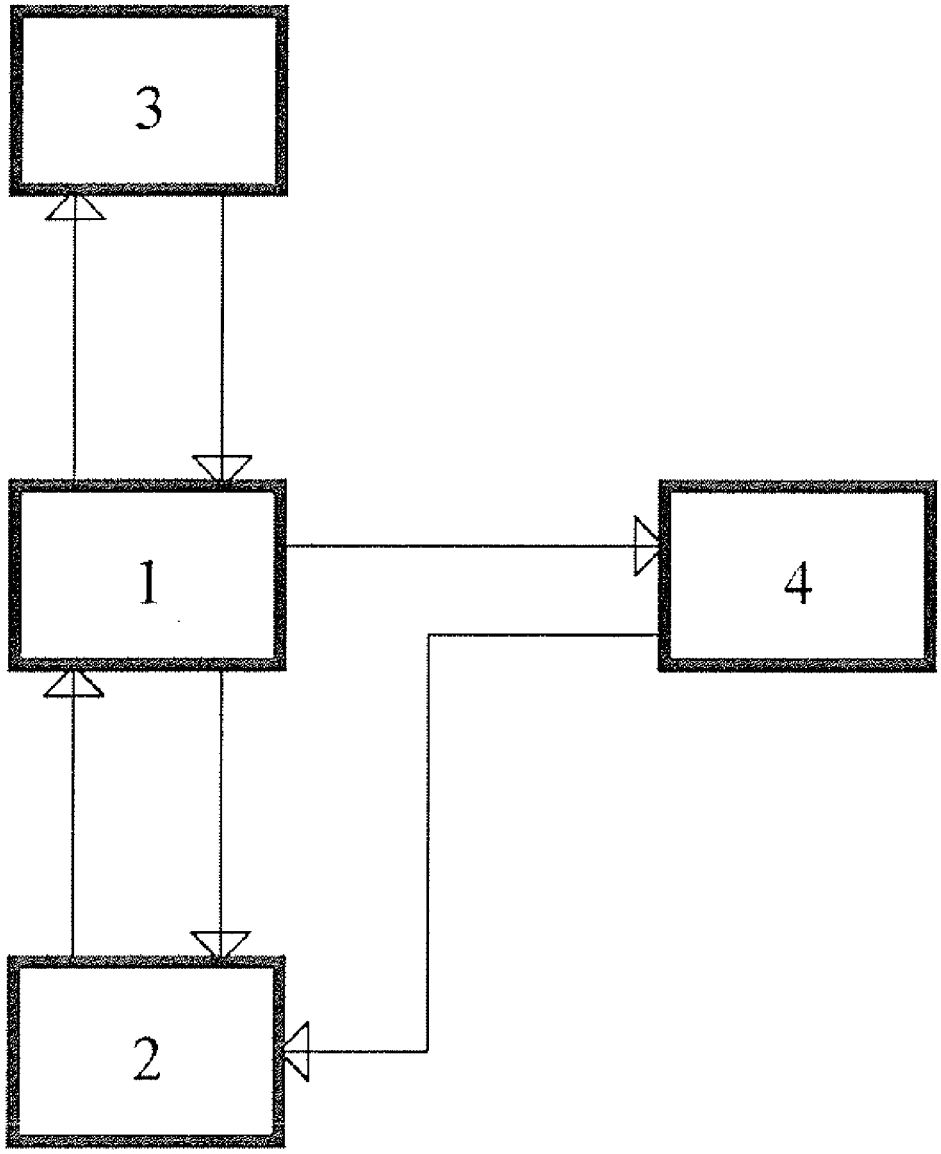
FIG. 1 is a block scheme of an embodiment of the present invention.

As shown in FIG. 1, the interrupter device of the present invention has four circuits: a ground fault circuit interrupter protection device circuit (1), an auto-monitoring circuit module for operation faults (2), a ground fault test circuit module (3), and a drive module (4).

The output of the ground fault circuit interrupter protection device circuit (1) is directly connected to the input of the ground fault test circuit module (3); the output of the ground fault circuit interrupter protection device circuit (1) is connected to the input of the drive module (4). The output of the drive module (4) is connected to the input of the auto-monitoring circuit module (2); the input of the auto-monitoring circuit module (2) is connected to the output of ground fault circuit interrupter protection device circuit (1); the output of the auto-monitoring circuit module (2) is connected to the input of the ground fault circuit interrupter protection device circuit (1); the output of the ground fault test circuit module (3) is connected to the input of the ground fault circuit interrupter protection device circuit (1).

Figure 1A:
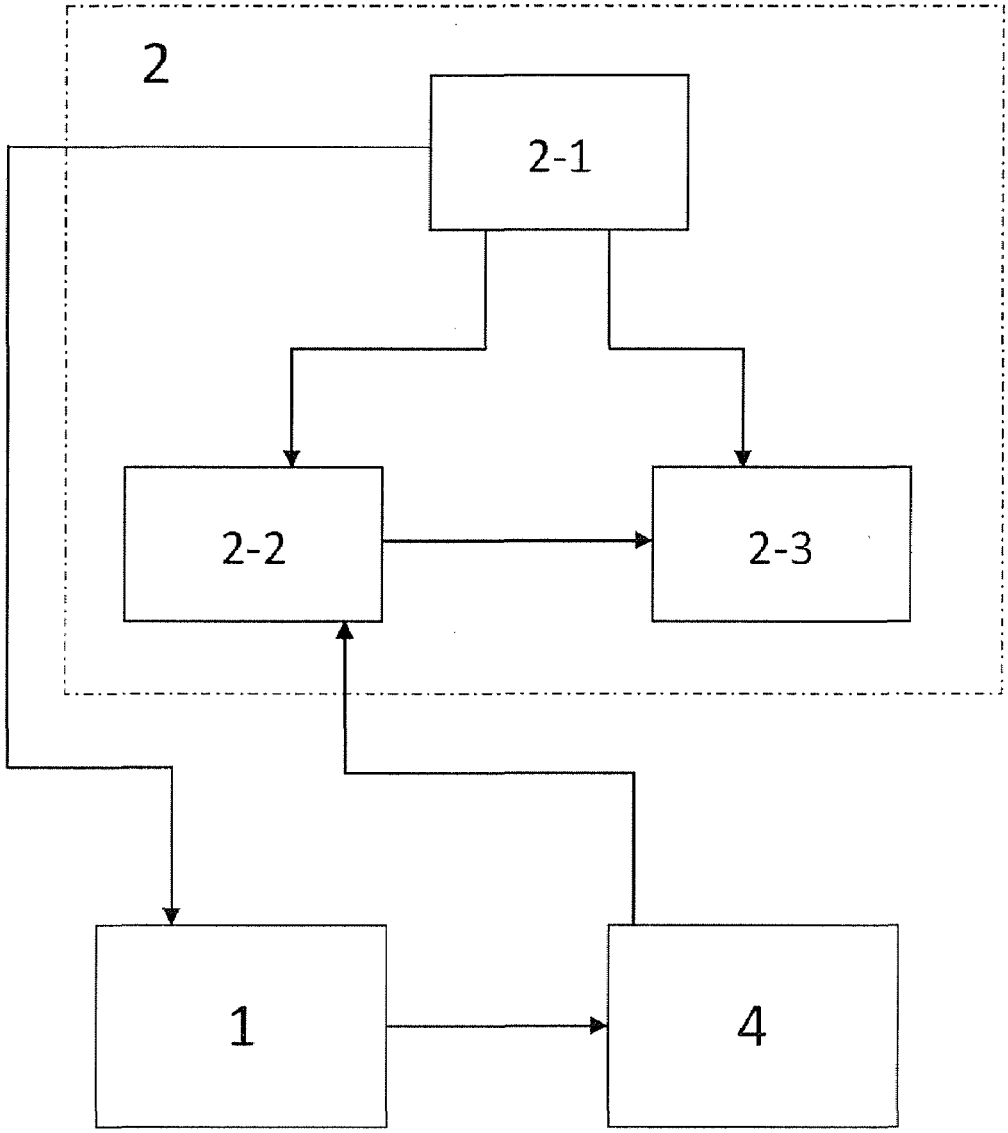
FIG. 1A is a block scheme of the circuit module (2) depicted in FIG. 1.

As shown in FIG. 1A, the auto-monitoring circuit module (2) contains a master control system (2-1), a monitoring system (2-2), and a signaling system (2-3).

The output of the master control system (2-1) is connected to the input of the monitoring system (2-2); the output of the master control system (2-1) is also connected to the input of the signaling system (2-3) and the input of the ground fault circuit interrupter protection device (1); the output of the monitoring system (2-2) is connected to the input of the signaling system (2-3); the output of the ground fault circuit interrupter protection device (1) is connected to the input of the drive module (4); the output of the drive module (4) is connected to the input of the monitoring system (2-2).

Figure 2:
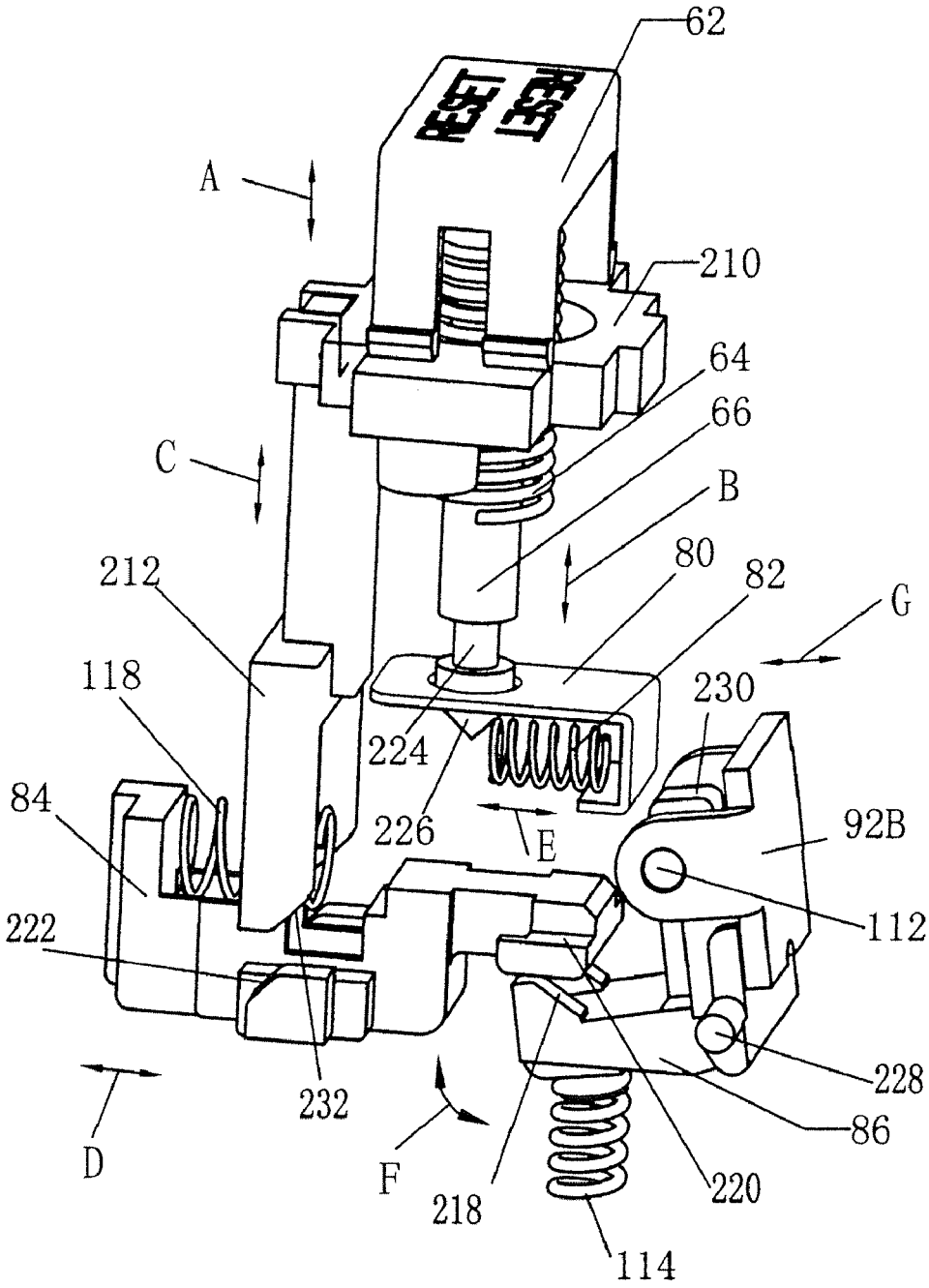
FIG. 2 is a perspective view of the embodiment as depicted in FIG. 1.

FIG. 2 shows the internal of the GFCI device in the tripped state. A reset button (62) moves upward and downward along direction A and is connected to a reset pull rod (66) which has a cone-shaped head (226) at an end and a groove (224) in the middle. The reset pull rod (66) moves upward and downward along direction B. A reset push rod (212) is connected to a reset guide board (210) underneath the reset button (62); a moveable crosshead (84) underneath the reset push rod (212) has a reset spring (118), and the reset push rod (212), through the reset guide board spring (214), moves upward and downward along direction C. When the slant surface (222) of the moveable crosshead (84) makes contact with the corresponding slant surface (232) of the reset push rod (212), it causes the moveable crosshead (84) to move towards the right side along direction D; when the reset push rod (212) arises, the moveable crosshead (84) moves toward the left side along direction D by the tensile stress of the reset spring (118). The cone-shaped head (226) of the reset pull rod (66) rests on the moveable crosshead (84) and is locked in a metal latch (80) which has a latch spring (82) that moves laterally along direction E.

A moveable gangplank (86) is placed next to a solenoid (90) on the left side (shown in FIGS. 3 and 5) and a pivoted moveable magnet (92B) is placed between the moveable gangplank (86) and the solenoid (90) and attached to the right of the moveable gangplank (86). The moveable magnet (92B) and the moveable gangplank (86) are connected through a lock pin (112). A gangplank spring (114) is placed underneath the moveable gangplank (86); the moveable gangplank (86), lock pin (112), and gangplank spring (114) become an integrated part. Whenever reset or trip operation occurs, the moveable gangplank (86) moves upward and downward along direction F. The moveable magnet (92B) of the moveable gangplank (86) moves from one side to another along direction G by a pivot point (228). The moveable gangplank (86) is engaged underneath a suspension hook (220) of the moveable crosshead (84).

Figure 3:
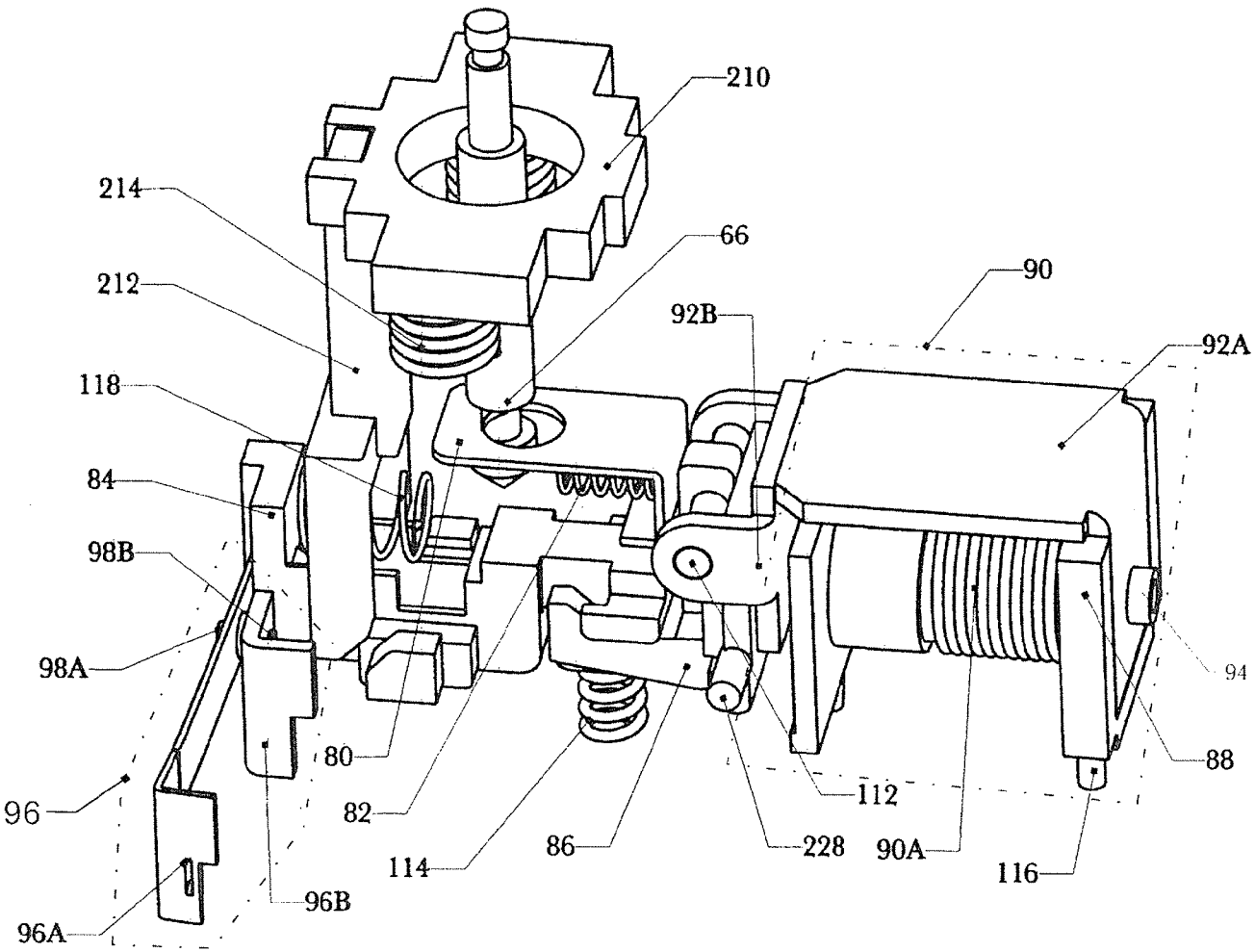
FIG. 3 is a perspective view of the embodiment as depicted in FIG. 2 in the trip state.

FIG. 3 explains the reset operation. The newly assembled GFCI device of the present invention is in the tripped state. Therefore, to start operation, power supply is provided and the device is reset by pressing the reset button (62). When the reset button (62) is pressed, the cone-shaped head (226) of the reset pull rod (66) enters into and is engaged in the semi-elliptical hole of the metal latch (80).

As seen in FIG. 2, the reset button (62) is pressed downward, the reset push rod (212) which is connected to the reset guide board (210) also moves downward; the slant surface (232) of the reset push rod (212) makes contact with the slant surface (222) of the moveable crosshead (84) and pushes the moveable crosshead (84) to move to the right side. The movement starts to compress the reset spring (118), while the suspension hook (220) of the moveable crosshead (84) disconnects from the slant surface (218) of the moveable gangplank (86), hereby allows the gangplank spring (114) to stretch and push the gangplank (86) to move upward along direction F and to rotate around the pivot point (228); the top (230) of the moveable gangplank (86) pushes the moveable magnet (92B) to move towards the right side and being closer to a fixed magnet (92A) so that the moveable magnet (92B) and the fixed magnet (92A) are close to the solenoid (90).

When the cone-shaped head (226) of the reset pull rod (66) is engaged in the hole of metal latch (80), through the tensile stress of the latch spring (82), the metal latch (80) moves to the right side and consequently engages in the groove (224) of the reset pull rod (66).

The solenoid (90), which is used to trigger the interrupter device of the present invention to reset and trip, comprises a solenoid bobbin (88), a plunger (94), and the fixed magnet (92A). The plunger (94) passes through the internal hole of the solenoid bobbin (88) and is wielded to the fixed magnet (92A) on the back of solenoid (90). A solenoid coil (90A) winds around the outside of the solenoid bobbin (88) to form the solenoid (90). When an electric current flows through, the solenoid becomes electromagnet, and the plunger (94) and fixed magnet (92A) become magnetic.

Figure 4:
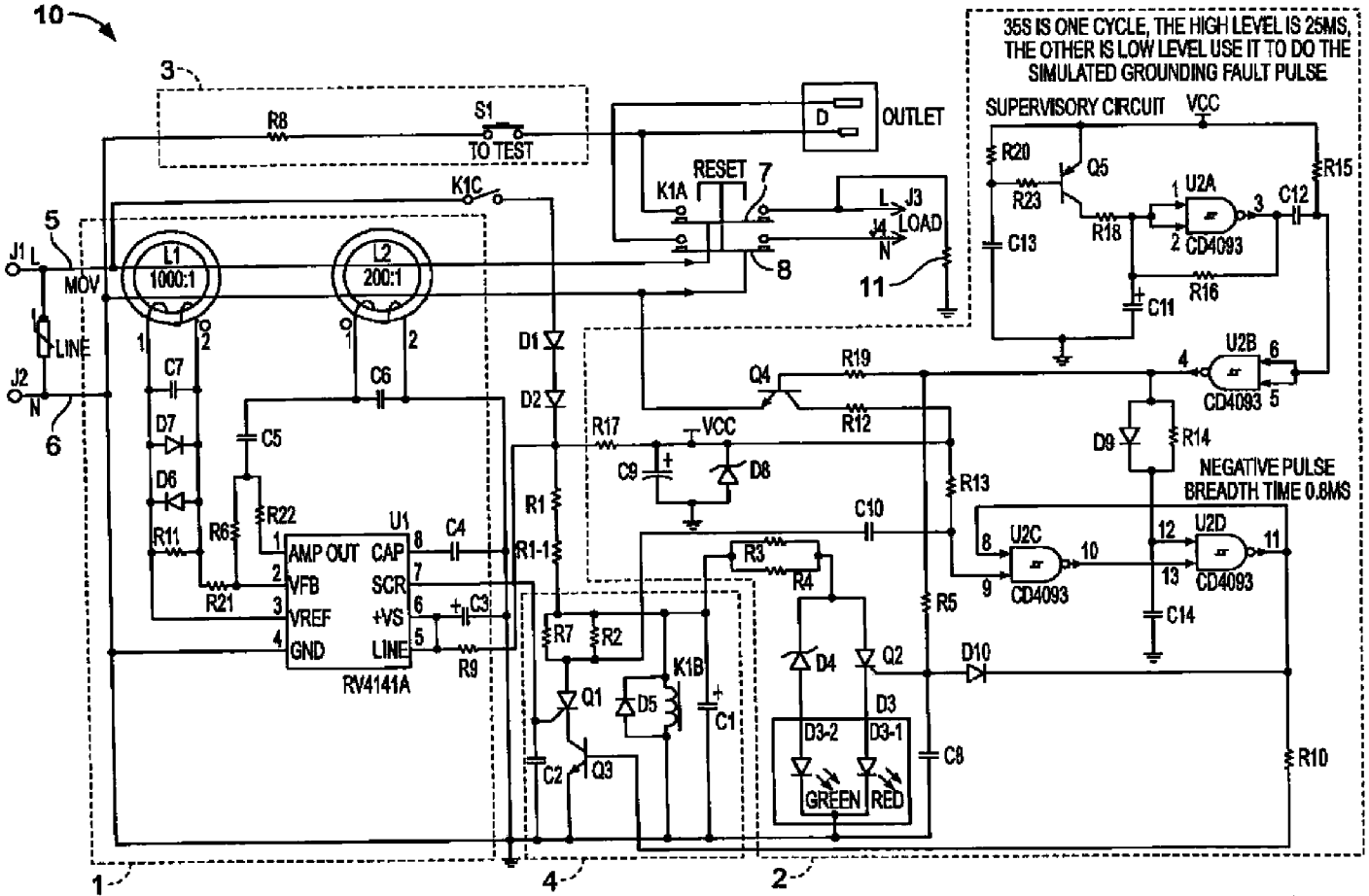
FIG. 4 is a circuit scheme of the embodiment as depicted in FIG. 1.

Referring to FIG. 4, the device (10) of the present invention contains a ground fault circuit interrupter protection device (1). A resistor (11) stands for a simulated ground fault. The simulated ground fault generates additional current in a conducting wire (5), while the current is not in a conducting wire (6). A sensor (L1) senses the differential current between the conducting wire (5) and (6); the differential current is also detected by a ground fault detector (GD) (shown in FIG. 7). If the value of the differential current exceeds a preset threshold (6 mA), the ground fault detector (GD) sends out a simulated signal and trip dictate to a silicon-controlled rectifier SCR (Q1) so that SCR Q1 becomes conductive and the two ends of the solenoid (K1B) loses electric potential, thus, the magnet of the solenoid (K1B) loses magnet and releases. Subsequently, the mechanical device trips so that the moveable contact (7) and (8) of J1 and J2 separate from the fixed contacts of the OUTLET and from the fixed contacts of the LOAD terminal J3 and J4 to form the ground fault protection device.

The circuit module (2) of the present invention as shown in FIG. 4 automatically monitors whether the ground fault test circuit of the device (1) has reached its end-of-life or operation faults occur. For examples, the ground fault detector (GD) consists of electronic parts, which have normal wear and tear or bad wielding, or reach its end of life, or malfunction; the integrated circuit may reach its end of life or short circuit caused by electronic surge from thunder; the solenoid may become open circuit or short circuit and damaged due to faults; trip mechanism may not work properly due to tear and wear or corrosion due to a working time. Furthermore, power supply may be inadequate so that the integrated circuit, sensor L1 and L2, detector GD, or solenoid malfunction. When the GFCI has an operation fault, the auto-monitoring system of the present invention provides an alarm signal to the user. For instance, some alarm signal indicates that one or more parts of the device has reached its end-of-life.

As shown in FIG. 4, the ground fault test circuit (3), has a test contact (S1) and a resistor (R8). When the test contact (S1) was pressed, additional current passes through the resistor (R8) in a preset period of time which is counted from the time when the test contact (S1) is pressed to when contacts (7) and (8) are released. The interval is usually set at 25 ms. The differential current between the lines of the conducting wire (5) and (6) is sensed by the sensor (L1), detected by the detector (GD), which causes the device (10) to trip through the coordinated action of the SCR (Q1) and solenoid (K1B). In a 120-voltage power system, the value for the test resistor in the test circuit is 15 kΩ in accordance with the UL regulation.

As shown in FIG. 4, the GFCI device (10) of the present invention also includes a drive module (4) which mainly consists of solenoid (K1B), SCR (Q1), and a triode (Q3); the solenoid (K1B) triggers the trip mechanism to disconnect from the power source. When the ground fault test circuit module (3) detects a ground fault signal, it drives the SCR (Q1) to become conductive, which further causes the solenoid (K1B) to become isoelectric and lose magnetism. Then, the moveable magnetic contacts separate from the fixed magnetic contacts which drives the trip mechanism and cuts off the power source. Therefore, the device is protected from the ground fault.

Figure 5:
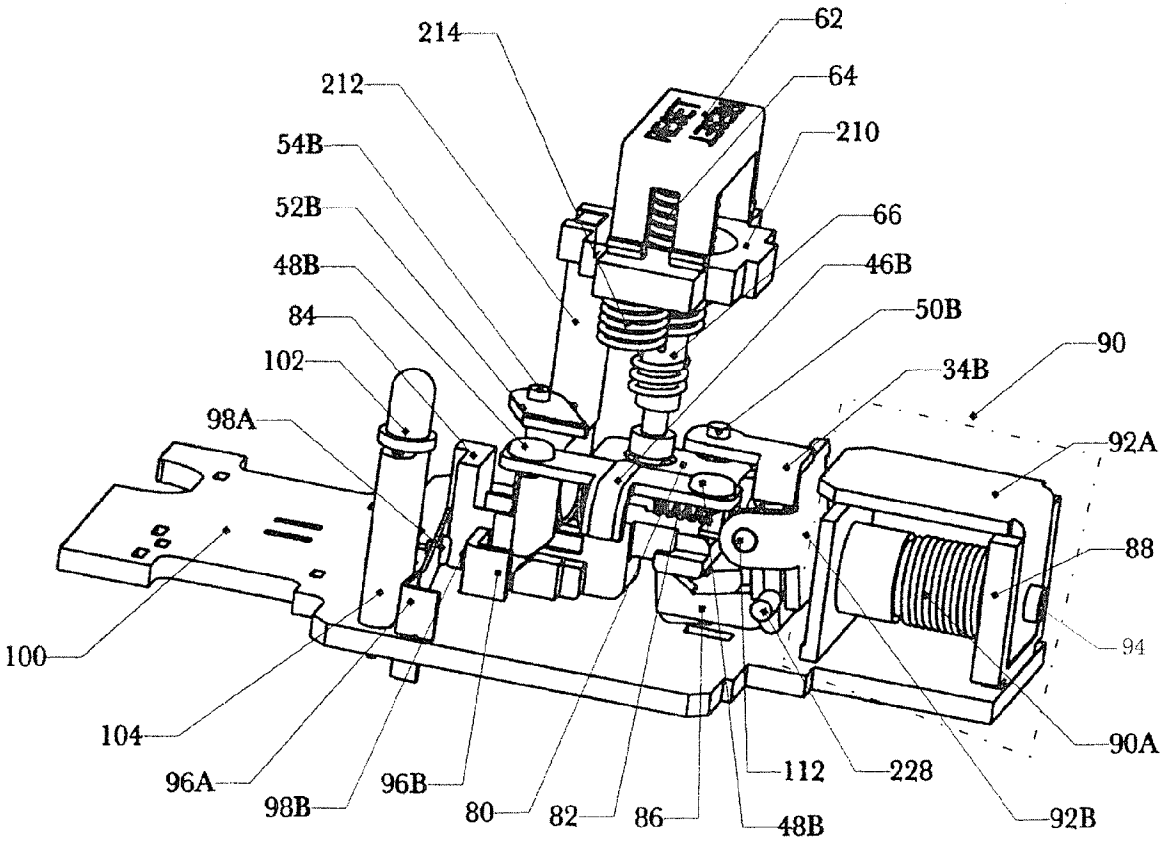
FIG. 5 is a partial sectional view of a mechanical implementation of an embodiment of the invention.

As shown in FIGS. 2 and 5, the device is in the trip state. When the GFCI is in the reset state during normal operation and any of the following events occurs, including ground fault, wear and tear of major electric parts including the solenoid (90), short circuit or open circuit of the solenoid coil (90A), power failure due to outside breakdown, the solenoid (90) stops working immediately, the plunger (94) and the fixed magnetic (92A) lose the magnetism, and the moveable magnet contact (92B) is released. Then, the moveable crosshead (84) moves to the left side along direction D as shown in FIG. 2, thus, returns to the trip state. Thus, the suspension hook (220) of the moveable crosshead (84) makes contact with the slant surface (218) of the moveable gangplank (86) and presses the movable gangplank downwards along direction F as seen in FIG. 2. When the moveable gangplank (86) moves down, the pivot point (228) rotates and makes the top (230) of the moveable gangplank (86) move towards the left side along direction G, pushing the metal latch (80) to move towards the left side along direction E, which in turn presses the latch spring (82) so that the latch hole is disengaged from the groove (224) of the reset pull rod (66). Subsequently, the reset spring (64) begins to extend, pushing up the reset button (62) to trip which causes the separation of the line moveable contacts (48A) and (48B) from the output fixed contacts (54A) and (54B) and from the load fixed contacts (50A) and (50B) and cutoff of the power. (Contacts (48A), (54A), and (50A) are not marked in the figures.)

When the moveable crosshead (84) returns, it pushes the moveable contact arm (96A) of the auxiliary switch (96) to disconnect the auxiliary moveable contact (98A) from the auxiliary fixed contact (98B) which is wielded on the auxiliary fixed contact (96B) of the auxiliary switch (96), thus cut off the power source for all electric parts on the same printed circuit board and leave them with no electricity.

Figure 6:
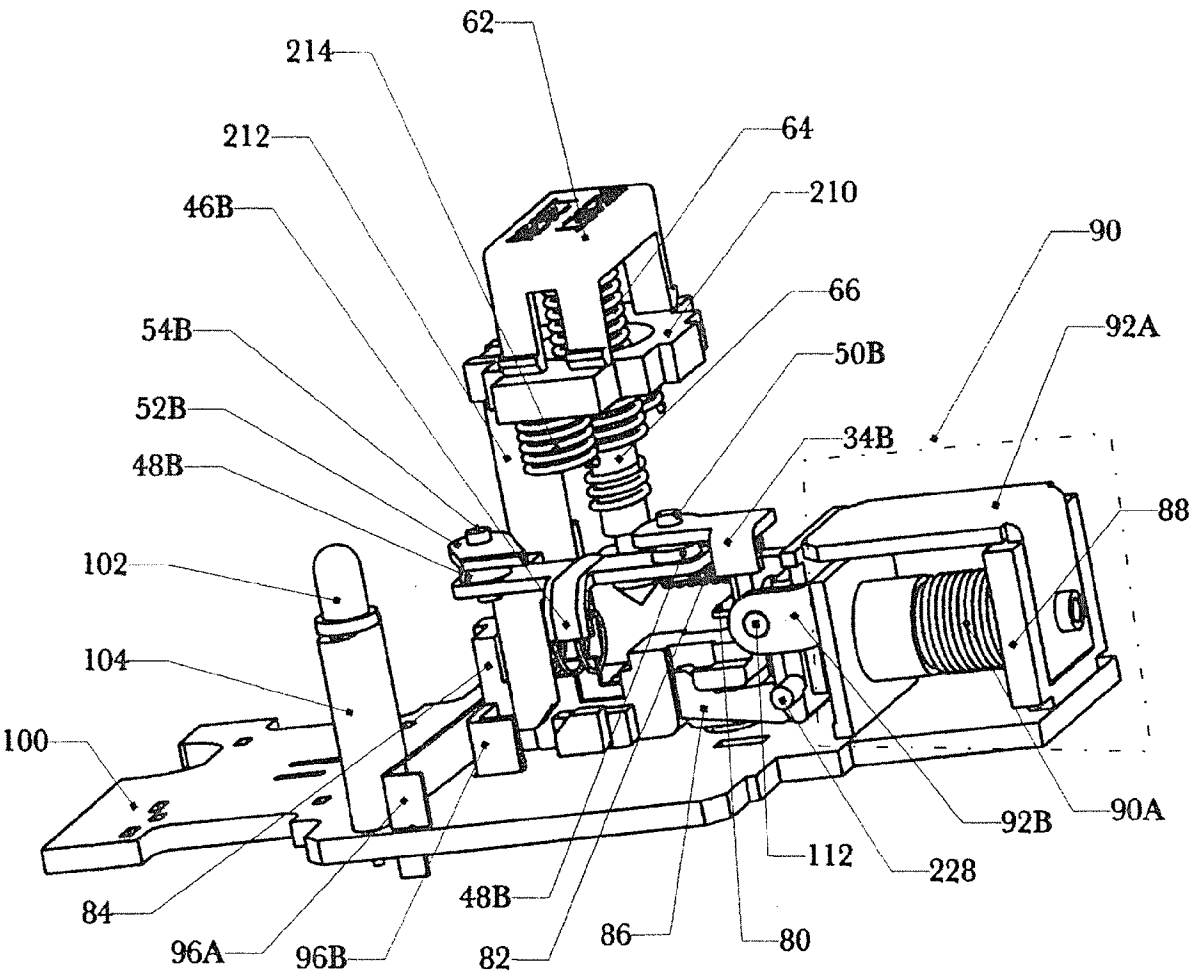
FIG. 6 is a partial sectional view of a mechanical implementation as depicted in FIG. 4 in the reset state.

FIG. 6 in combination with FIG. 2 explains the reset of the mechanical device. When power outage occurs or the GFCI device is tested periodically, the device will trip during normal operation. When the power is supplied to the device, the GFCI restarts working at the press of the reset button (62). When the reset button (62) is pressed, it moves downward along direction A (see FIG. 2), while the reset push rod (212) connected to the reset guide board (210) underneath the reset button (62) moves downward along direction C and the slant surface (232) of the reset push rod (212) makes contact with the slant surface (222) of the moveable crosshead (84). When the reset button (62) is pressed further, the reset push rod pushes the moveable crosshead (84), which has a reset spring (118), to move to the right side along direction D. At this time, due to the tensile stress of the gangplank spring (114), the moveable gangplank (86) arises along the pivot point (228) and gets engaged in the hook (220) of the moveable crosshead (84). The top (230) of the moveable gangplank (86) moves to the right side and releases the metal latch (80), then, the latch spring (82) begins to extend towards the right side. Simultaneously, the cone-shaped head (226) of the reset pull rod (66) passes through the hole on the metal latch (80) when the reset button (62) is pressed, thus the groove (224) of the reset pull rod (66) is engaged in the metal latch (80), while the moveable magnet (92B) moves to the right to contact the solenoid (90) (See FIG. 3). When the reset button (62) is released, the reset spring (64) begins to extend which pulls the reset pull rod (66) to arise together with the lift (74) having two line moveable contact arm (46A) and (46B) due to the engagement of the reset pull rod (66) in the metal latch (80). Then, the GFCI becomes conductive, i.e., the two line moveable contacts (48A) and (48B) contact with the two output fixed contacts (54B) and load fixed contacts (50B). When the reset operation concludes, the dual-color indicator lamp (102) of the device sends out green light to indicate the normal operation of the device.

Figure 7:
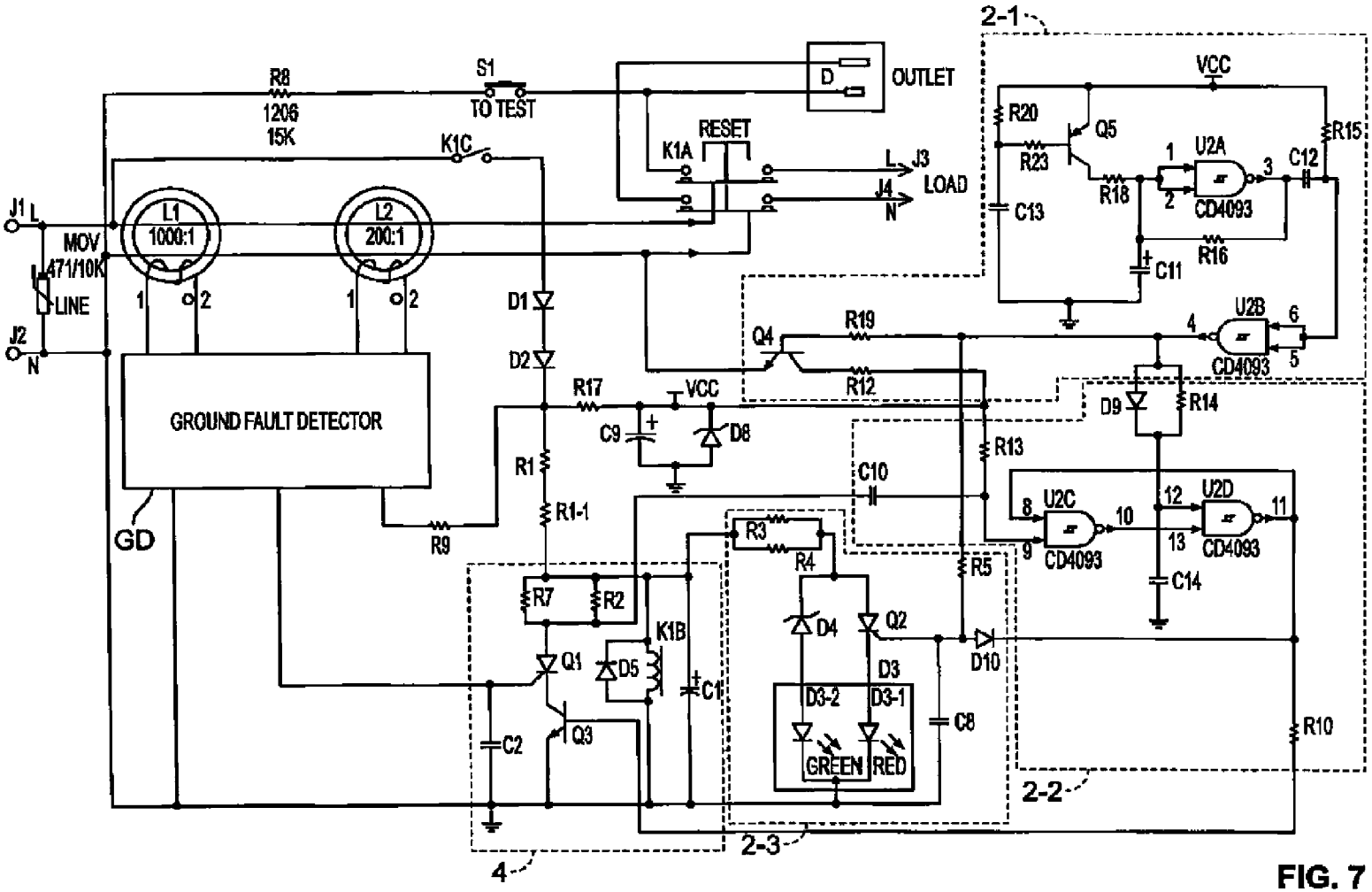
FIG. 7 is a scheme of the auto-monitoring of the end-of-life circuit as depicted in FIG. 4.

FIG. 7 further explains the automatic detection of the operation faults and signal alarms of the present invention. The auto-monitoring circuit module (2) may use the integrated block CD4093 as its core processing center. The circuit module (2) has three major systems, the master control system (2-1), monitoring system (2-2), and signaling system (2-3), to form an auto-monitoring alarm circuit.

The output of the master control system (2-1) is connected to the input of the monitoring system (2-2); the output of the master control system (2-1) is also connected to the input of the signaling system (2-3) and the input of the ground fault circuit interrupter protection device (1); the output of the monitoring system (2-2) is connected to the input of the signaling system (2-3); the output of the ground fault circuit interrupter protection device (1) is connected to the input of the drive module (4); the output of the drive module (4) is connected to the input of the monitoring system (2-2).

The master control system (2-1) mainly functions in automatic scanning, generating simulated ground fault, and triggering the indication lamp in the signaling system (2-3). The circuit generates periodic impulse for driving. The frequency of the impulse is 2.4 ms, thus the time for the simulated ground fault is 2.4 ms as well; at the same time, the signaling system (2-3) is triggered to send out alarm signal; the impulse is also used for a comparison by the comparator of the monitoring system (2-2) to judge whether the GFCI is in good working order. The master control system (2-1) contains: one end of resistor R20, resistor R23, and capacitor C13 are connected; one end of resistor R20, triode Q5, resistor R15, and resistor R12 are connected to the VCC (positive end of the electricity power); one end of resistor R23 and triode Q5 are connected; one end of triode Q5 and resistor R18 are connected; one end of capacitor C13 and capacitor C11 are connected to the power terminal; one end of resistor R18, capacitor C11, and resistor R16 are connected to pin 1 and pin 2 of the integrated block U2A; one end of resistor R16 and capacitor C12 are connected to pin 3 of the integrated block U2A; one end of resistor R15 and capacitor C12 are connected to pin 5 and pin 6 of the integrated block U2B; one end of resistor R19, resistor R5, diode D9, and resistor R14 are connected to pin 4 of the integrated block U2B; one end of resistor R19 and triode Q4 are connected; one end of triode Q4 and resistor R12 are connected; one end of triode Q4 is connected to the power line N which has passed through a signal transformer L1 and neutral transformer L2.

The monitoring system (2-2) has a monitoring circuit formed by the combination of a detector and a comparator. In the monitoring circuit, a capacitor C10 couples a signal from the SCR Q1 of the drive module (4) to pin 9 of the integrated block U2C for sampling. Pin 8 of the integrated block U2C and pin 11 of the integrated block U2D are connected and form an interlocking amplifier and comparator. Signal of pin 12 of the integrated block U2D as provided by the master control system (2-1) and that of pin 13 of the integrated block U2D are compared. Pin 11 of the integrated block U2D controls the alarming status of the signaling system (2-3) and prevents mistrip from a simulated ground fault through the control of on or off of the triode Q3 of the drive module (4).

The monitoring system (2-2) has the following components: one end of capacitor C10, resistor R2, resistor R7, and triode Q1 are connected; one end of capacitor C10 and resistor R13 are connected to pin 9 of the integrated block U2C; one end of diode D10 and resistor R10 are connected to pin 8 of the integrated block U2C and to pin 11 of the integrated block U2D; one end of diode D9, resistor R14, and capacitor C14 are connected to pin 12 of the integrated block U2D; one end of resistor R10 and triode Q3 are connect; one end of capacitor C14 is connected to the power ground line N.

The signaling system (2-3) provides alarm signal by a dual-color light-emitting diode, and has a signaling circuit formed by SCRs, voltage-stabilizing diode, resistors, and capacitors. The dual-color light-emitting diode (D3-2) of the signaling circuit emits green light when the GFCI is in normal operation; the diode (D3-2) turns off when the GFCI is in trip state. When the GFCI has any operation faults, such as aging of the parts, end-of-life, short circuit, or open circuit, the master control system (2-1) triggers the signaling system (2-3) through resistor R5 and makes the dual-color light-emitting diode D3-1 to emit red light, thus, to remind the user to replace the GFCI device.

The dual-color light-emitting D3 is an example for illustrating the alarm signaling system. The alarm signals may be provided by means including, but not limited to, a visual indicator, a lamp, an alarm indicator, an audio device, a frequency generator, or any system which may be used for alarm signaling. The visual indicator may send alarm signal to the user through frequency twinkling indication.

The signaling system (2-3) has the following components: one end of resistor R5, diode D10, capacitor C8, and SCR Q2 are connected; one end of resistor R3 and resistor R4 are connected to one end of capacitor C1, solenoid K1B, diode D5, resistor R2, resistor R7, and resistor R1-1; one end of diode D4 and SCR Q2 are connected to one end of resistor R3 and resistor R4; one end of voltage-stabilizing diode D4 and light-emitting diode D3-2 are connected; one end of SCR Q2 and light-emitting diode D3 are connected; one end of the light-emitting diode D3 and capacitor C8 are connected to power ground line N.

The auto-monitoring circuit module (2) works as follows: the master control system (2-1) generates an intermittent impulse by the concerted action of resistor R20, capacitor C13, triode Q5, resistor R23, resistor R18, capacitor C12, integrated block U2A, and resistor R16. The intermittent impulse simulates a ground fault signal as amplified by triode Q4 which is triggered by resistor R19; additionally, SCR Q2 becomes conductive through resistor R5 and acts to turn on the red light (D3-1) of the light-emitting diode D3 to show the operation of the module; at the same time, the signal reaches pin 12 of the integrated block U2D via diode D9 and resistor R14.

When the ground fault circuit module 1 functions properly, the simulated ground fault signal as amplified through the circuit module 1 reaches the drive module 4, which makes SCR Q1 conductive. The anode of SCR Q1 becomes at lower electric level. Pin 9 of the integrated block U2C in the monitoring system (2-2) is coupled by capacitor C10, and becomes at lower electric level. Pin 10 of the integrated block U2C changes to higher electric level, and both pins 12 and 13 of the integrated block U2D become at higher electric level. Pin 11 of the integrated block U2D changes to lower electric level, which closes at the triode Q3, and in turn makes the anode of SCR Q1 to be back at higher electric level. Therefore, both electrodes of the solenoid K1B are kept at higher electric potential, and the device will not trip. At the same time, pin 11 of the integrated block U2D at the lower electric level changes SCR Q2 of signaling system (2-3) to lower electric level through diode D10; SCR Q2 turns off the red light and turns on the green light to show the normal operation of the device.

When the ground fault circuit module 1 malfunctions (for example, loses its ground fault function), the anode of the SCR Q1 is kept at higher electric level, because the simulated ground fault signal can neither be amplified and pass through the circuit module 1 nor reach drive module 4 to open SCR Q1. Pin 9 is coupled by capacitor C10 and remains at higher electric level. Pin 10 remains at lower electric level, and pin 13 is at lower electric level and pin 12 at higher electric level. Pin 11 remains at higher electric level. SCR Q2 becomes conductive and enlightens the red light D3-1 to provide warning to the user that the GFCI device has operation fault or reaches its end of life and should be replaced or mended.

The drawings and embodiments of the present invention are to illustrate the function, structure, and principle of the present invention, while they do not serve to limit the scope of the present invention. Variations of the embodiments may occur which are still within the scope of the present invention.

We claim:

1. A circuit protection device comprising a ground fault circuit interrupter protection device (1), a ground fault test circuit module (3), a drive module (4) having a solenoid K1B, an SCR Q1, and a triode Q3, and a circuit module (2) having a master control system (2-1) that periodically sends out an impulse that simulates an electric shock signal, a monitoring system (2-2) that has an interlocking amplifier and comparator, and a signaling system (2-3) that indicates normal or faulty operation of the device, wherein an input of the circuit module (2) is connected to an output of the ground fault circuit interrupter protecting device (1); an output of the circuit module (2) is connected to an input of the ground fault circuit interrupter protecting device (1); an input of the circuit module (2) is connected to an output of the drive module (4), wherein the master control system (2-1) is connected to a power input line N; the monitoring system (2-2) is connected to an anode of the SCR Q1 and a base of the triode Q3; the signaling system (2-3) is connected to two input pins of the solenoid K1B, and wherein the master control system (2-1) comprises a resistor R20, a resistor R23, and a capacitor C13, each having one end connected together; another end of the resistor R20, and a first end of a triode Q5, a resistor R15, and a resistor R12, all being connected to a VCC; a resistor R23 having one end connected to a second end of the triode Q5; a resistor R18 having one end connected to a third end of the triode Q5; another end of the capacitor C13 and one end of a capacitor C11, both being connected to a power input; another end of the resistor R18, capacitor C11, and one end of a resistor R16, all being connected to pin 1 and pin 2 of an integrated block U2A; another end of the resistor R16 and one end of a capacitor C12, both being connected to pin 3 of the integrated block U2A; another end of the resistor R15 and another end of the capacitor C12, both being connected to pin 5 and pin 6 of an integrated block U2B; a resistor R19, a resistor R5, a diode D9, and a resistor R14, all having one end connected to pin 4 of the integrated block U2B; another end of resistor R19 and a first end of a triode Q4 being connected; a second end of the triode Q4 and another end of the resistor R12 being connected; a third end of the triode Q4 being connected to the power input line N which has passed through a signal transformer L1 and a neutral transformer L2.

2. A circuit protection device comprising a ground fault circuit interrupter protection device (1), a ground fault test circuit module (3), a drive module (4) having a solenoid K1B, an SCR Q1, and a triode Q3, and a circuit module (2) having a master control system (2-1) that periodically sends out an impulse that simulates an electric shock signal, a monitoring system (2-2) that has an interlocking amplifier and comparator, and a signaling system (2-3) that indicates normal or faulty operation of the device, wherein an input of the circuit module (2) is connected to an output of the ground fault circuit interrupter protecting device (1); an output of the circuit module (2) is connected to an input of the ground fault circuit interrupter protecting device (1); an input of the circuit module (2) is connected to an output of the drive module (4), wherein the master control system (2-1) is connected to a power input line N; the monitoring system (2-2) is connected to an anode of the SCR Q1 and a base of the triode Q3; the signaling system (2-3) is connected to two input pins of the solenoid K1B, and wherein the monitoring system (2-2) comprises: a capacitor C10, a resistor R2, a resistor R7, and a triode Q1, each having one end connected together;

another end of the capacitor C10 and one end of a resistor R13, both being connected to pin 9 of an integrated block U2C;

a diode D10 and a resistor R10, both having one end being connected to pin 8 of U2C and to pin 11 of an integrated block U2D;

a diode D9, a resistor R14, and a capacitor C14, all having one end connected to pin 12 of U2D;

another end of the resistor R10 and a first end of the triode Q3 being connected;

another end of the capacitor C14 being connected to the power ground line N; and wherein the capacitor C10 couples a signal from the SCR Q1 to pin 9 of U2C, and after amplified by U2C and compared by U2D, controls an alarming status of the signaling system (2-3) and prevents mistrip through on or off of the triode Q3.

3. A circuit protection device comprising a ground fault circuit interrupter protection device (1), a ground fault test circuit module (3), a drive module (4) having a solenoid K1B, an SCR Q1, and a triode Q3, and a circuit module (2) having a master control system (2-1) that periodically sends out an impulse that simulates an electric shock signal, a monitoring system (2-2) that has an interlocking amplifier and comparator, and a signaling system (2-3) that indicates normal or faulty operation of the device, wherein an input of the circuit module (2) is connected to an output of the ground fault circuit interrupter protecting device (1); an output of the circuit module (2) is connected to an input of the ground fault circuit interrupter protecting device (1); an input of the circuit module (2) is connected to an output of the drive module (4), wherein the master control system (2-1) is connected to a power input line N; the monitoring system (2-2) is connected to an anode of the SCR Q1 and a base of the triode Q3; the signaling system (2-3) is connected to two input pins of the solenoid K1B, and wherein the signaling system (2-3) comprises a resistor R5, a diode D10, a capacitor C8, and an SCR Q2, having one end being connected;

a resistor R3 and a resistor R4 having one end being connected to one end of the capacitor C1, the solenoid K1B, a diode D5, a resistor R2, a resistor R7, and a resistor R1-1;

a voltage-stabilizing diode D4 and an SCR Q2, both having one end connected to another end of the resistor R3 and another end of the resistor R4;

another end of the diode D4 being connected to a light-emitting diode D3-2 of D3;

another end of the SCR Q2 and a light-emitting diode D3-1 of D3 are connected;

one end of the D3 and another end of the capacitor C8 being connected to power ground line N; and wherein the master control system (2-1) triggers the signaling system (2-3) through the resistor R5 to turn on the light-emitting diode D3-1, and turns on or off of the light-emitting diode D3-1 through controlling the monitoring system (2-2) via the diode D10.

4. The circuit protection device according to claim 1, wherein the signaling system (2-3) comprises a visual alarm, au audible alarm, an alarm through a RF wireless transmission, an alarm through a wave carrier transmission, or a combination thereof.

5. The circuit protection device according to claim 4, wherein the signaling system (2-3) has a visual alarm which comprises dual-color light-emitting diodes.

6. The circuit protection device according to claim 5, wherein the dual-color light-emitting diodes emit one color for indicating tripping.

7. The circuit protection device according to claim 5, wherein the dual-color light-emitting diodes emit at least one color for indicating operation fault.

8. The circuit protection device according to claim 5, wherein the dual-color light-emitting diodes emit green light to indicate normal operation.

9. The circuit protection device according to claim 4, wherein the visual alarm indicates an end-of-life of the device via periodical glitter.

10. The circuit protection device according to claim 9, wherein the visual alarm emits red for indicating the end-of-life.

11. The circuit protection device according to claim 5, wherein the dual-color light-emitting diode emits green light to indicate normal operation.

12. The circuit protection device according to claim 4, wherein the signaling system (2-3) comprises an audible alarm.

13. The circuit protection device according to claim 4, wherein the signaling system (2-3) comprises an alarm through a RF wireless transmission.

14. The circuit protection device according to claim 4, wherein the signaling system (2-3) comprises an alarm through a wave carrier transmission.

15. The circuit protection device according to claim 1, further comprising an end of life system that is respectively connected to a positive pin of the SCR Q1 and the base of the triode Q3, and activates an end of life alarm when the system detects a failure to response to a simulated ground fault signal by the drive module (4) or by the circuit interrupter protective device (1).

16. The circuit protection device according to claim 1, wherein the device is a GFCI receptacle, a GFCI plug, a GFCI breaker, or a GFCI switch.

17. The circuit protection device according to claim 2, wherein the signaling system (2-3) comprises a visual alarm, au audible alarm, an alarm through a RF wireless transmission, an alarm through a wave carrier transmission, or a combination thereof.

18. The circuit protection device according to claim 2, further comprising an end of life system that is respectively connected to a positive pin of the SCR Q1 and the base of the triode Q3, and activates an end of life alarm when the system detects a failure to response to a simulated ground fault signal by the drive module (4) or by the circuit interrupter protective device (1).

19. The circuit protection device according to claim 3, wherein the signaling system (2-3) comprises a visual alarm, au audible alarm, an alarm through a RF wireless transmission, an alarm through a wave carrier transmission, or a combination thereof.

20. The circuit protection device according to claim 3, further comprising an end of life system that is respectively connected to a positive pin of the SCR Q1 and the base of the triode Q3, and activates an end of life alarm when the system detects a failure to response to a simulated ground fault signal by the drive module (4) or by the circuit interrupter protective device (1).

* * * * *